US005545078A

United States Patent [19]

Schulz et al.

[11] Patent Number: 5,545,078

[45] Date of Patent: Aug. 13, 1996

[54] QUICK-ACTION CLAMPING DEVICE FOR AXIALLY SECURING A DISK SHAPED TOOL

[75] Inventors: Manfred Schulz, Nurtingen; Gerhard Waldner, Neckarhausen; Alfred Wagemann, Nurtingen, all of Germany

[73] Assignee: Metabowerke GmbH & Co., Germany

[21] Appl. No.: 152,167

[22] Filed: Nov. 16, 1993

[30] Foreign Application Priority Data

Nov. 16, 1992 [DE] Germany ..... 42 38 466.4
Dec. 19, 1992 [DE] Germany ..... 42 43 328.2

[51] Int. Cl.[6] ..... B24B 41/00

[52] U.S. Cl. ..... 451/342; 451/340

[58] Field of Search ..... 451/340, 342, 451/359, 364, 362

[56] References Cited

U.S. PATENT DOCUMENTS

| | | | |
|---|---|---|---|
| 3,912,411 | 10/1975 | Moffat | 451/342 |
| 4,547,997 | 10/1985 | Kimmelaar et al. | 451/342 |
| 4,980,994 | 1/1991 | Helm et al. | 451/342 |
| 5,161,334 | 11/1992 | Schaal et al. | 451/342 |

FOREIGN PATENT DOCUMENTS

| | | |
|---|---|---|
| 0381809 | 8/1990 | European Pat. Off. . |
| 3012836A1 | 10/1981 | Germany . |
| WO88/04975 | 7/1988 | Germany . |
| WO88/04976 | 7/1988 | Germany . |
| 3700968C2 | 8/1988 | Germany . |
| 3903767A1 | 8/1990 | Germany . |
| 3903765A1 | 8/1990 | Germany . |
| 3917345A1 | 11/1990 | Germany . |
| WO90/06210 | 6/1990 | WIPO . |

*Primary Examiner*—Bruce M. Kisliuk
*Assistant Examiner*—Derris H. Banks
*Attorney, Agent, or Firm*—Jones, Tullar & Cooper, P.C.

[57] ABSTRACT

In a quick-action clamping device for axially securing a disk-shaped tool, particularly a grinding wheel on a flange of a driven spindle that has a clamping part provided with a thread that can be screwed to the thread of the spindle. The disk-shaped tool is held clamped between contact surfaces of the flange and the clamping part whose spacing from one another can be changed. It is proposed to avoid complete release of the tension nut during spindle stop operation in that the tool is pressed against the flange by means of at least one additional holding surface via a spring force, and that this additional holding surface is connected to the spindle in a manner secured against relative rotation.

26 Claims, 3 Drawing Sheets

QUICK-ACTION CLAMPING DEVICE FOR AXIALLY SECURING A DISK SHAPED TOOL

FIELD OF THE INVENTION

The present invention relates to a quick-action clamping device for axially securing a disk-shaped tool, particularly a grinding wheel on a flange of a driven spindle that has a clamping part provided with a thread that can be screwed to the thread of the spindle, wherein the disk-shaped tool is held clamped between contact surfaces of the flange and the clamping part whose spacing from one another can be changed.

BACKGROUND OF THE INVENTION

After the grinding wheel of known quick-action clamping devices for right-angle grinders has been positioned, the spindle is secured with a fork wrench or a built-in spindle stopping device; then a tension nut is positioned by hand and tightened by means of a wrench. This last step is actually superfluous. Upon activation, the spindle starts up quickly and jerkily so that, because of the mass inertia, an automatic clamping of the grinding wheel is effected by means of the tension nut. During subsequent operations the clamping device automatically tightens further.

To replace the tools, the spindle is held securely and the tension nut is loosened by means of a wrench, often with a considerable expenditure of strength. With machines that have a spindle stop, it is now possible to block the spindle abruptly, shortly before it comes to a dead stop, with the consequence that the grinding wheel rotates further because of its mass inertia, thereby loosening the tension nut. If this spindle stop is triggered at too high an rpm, the fast-running grinding wheel can screw the tension nut completely down. The still-rotating wheel can then fall off of the spindle and cause accidents and damage.

Various quick-action clamping devices for disk-shaped tools, all of which possess the described disadvantage, are known from German Published, Non-Examined Patent Applications 30 12 836, 37 00 968, 39 03 765, 39 03 767, 39 17 345, European Patent Disclosure EP 0 381 809, and International Patent Publications WO 88/04975 and WO 88/04976.

OBJECT AND SUMMARY OF THE INVENTION

To avoid the outlined disadvantage, an object of the present invention is to improve the quick-action clamping device described at the outset in such a way that complete unscrewing of the tension nut during operation of the spindle stop is not possible.

To attain this object, the present invention provides that the tool is pressed against the flange via a spring force, by means of at least one further holding surface of an additional clamping and friction part resting against the tool, and that this additional clamping and friction part is connected to the spindle in a manner secured against relative rotation.

The quick-action clamping device in accordance with the present invention includes tension nuts that can be screwed onto a threaded pin of the spindle, as well as tension screws that can be screwed into an inside thread of the spindle.

By means of this proposed measure, it is ensured that, shortly after the release of the prestress, the tension nut loses contact with the further-rotating, disk-shaped tool and can no longer be turned by it and completely unscrewed. A complete unscrewing of the loosened tension nut is now easily possible by hand, without a tool, so that no auxiliary tools are required for replacing tools.

It is particularly simple to design the clamping part so that it is disposed to be axially displaceable on the spindle, wherein the tool-side surface of this pressure disk forms the holding surface. To attain the spring force, at least one compression spring, preferably a compact disk spring, is provided between the two clamping parts.

In a particularly advantageous manner, the one clamping part can be provided with a recess for the other clamping and friction part and the compression spring, and the other clamping and friction part is held with axial play in this recess such that it is captively secured. In this way the quick-action clamping device is practically easy to handle in one piece. Maintenance and assembly are greatly facilitated by means of such a structural unit, and only very few parts must be handled during tool replacement. Assembly errors are also prevented in this way, and the structural volume in particular can be kept small.

In a space-saving manner, the axial play and, correspondingly, also the possible spring travel can be limited by a shoulder of the one clamping part and a surface of the other clamping and friction part that cooperates with this shoulder, wherein in the released state of the one clamping part, the surface of the other and friction clamping part is pressed with prestress against the shoulder of the one clamping part. In this embodiment, only relatively small prestress paths are required and, despite this, it is ensured that with a released prestress, the tension nut is no longer carried along by the momentum of the still-rotating, disk-shaped tool.

To secure the clamping and friction part against relative rotation with the spindle, it is particularly easy to provide the spindle with at least one longitudinal groove and the clamping and friction part with at least one catch that engages this longitudinal groove. In a useful manner, the securing device against relative rotation can be embodied symmetrically to prevent the spindle from shifting to one side. For example, two longitudinal grooves and two associated catches can respectively be provided.

To reduce production costs, the other clamping part and the flange disposed on the spindle can be secured against relative rotation on the spindle, such as in the form of flattenings, a groove and tongue, a laid-in key or the like.

It can be particularly simple to manufacture the one clamping part to have a cylindrical part with the inside thread and an adjacent disk-shaped part, wherein the compression spring is centered by means of the cylindrical part and is supported against the disk-shaped part. Furthermore, the disk-shaped part can support/have an axial ring at its outer circumference that has an inwardly-projecting shoulder at a distance from the disk-shaped part, wherein an outer side of the shoulder and a front face of the axial ring form the contact surface of the clamping part on the disk-shaped tool. In a useful manner, a one-way, torque-limiting clutch that only transmits a predetermined moment in the tightening direction and blocks in the loosening direction can be installed between the disk-shaped part and the ring.

It is provided in an advantageous further development that a device is provided between the two clamping parts or between the spindle and the clamping part that can be screwed onto the threaded pin, and at least partly reduces a relative motion between the two clamping parts.

By means of this proposed further development of a quick-action clamping device, it is ensured that, shortly after the prestress of the quick-action clamping device or the tension nut has been released, the clamping part screwed onto the threaded pin is slowed by means of the device of the present invention from the rpm of the spindle before its abrupt stop until it has stopped completely. As a result, the clamping part is prevented from rotating further because of its mass inertia and coming completely unscrewed from the threaded pin. Because the screwed-on clamping part is also stopped directly after the spindle has been stopped, there is no danger that the still-rotating grinding wheel will cause damage. Complete unscrewing of the loosened quick-action clamping device is now easily possible, because the clamping part screwed onto the threaded pin is no longer prestressed in the direction of the tool. Tool replacement can now take place without auxiliary tools.

A particularly advantageous embodiment provides that the device be embodied as a brake, and particularly as an O-ring or the like. If the spindle is braked abruptly by the operation of the spindle stop, then the clamping and friction part that is fixed against relative rotation with respect to the spindle is at rest and, via the brake, reduces the rpm of the clamping part screwed onto the thread, wherein the braking force is selected such that this screwed-on clamping part cannot unscrew itself from the threaded pin. Normally, this screwed-on clamping part only further executes a fraction of a rotation. Friction elements of this type are simpler and more economical to produce, and are moreover effortlessly replaceable when the wear limit has been reached. Furthermore, these are low-maintenance elements and can be easily installed.

A clutch that transmits a specific torque and is only effective in one direction of rotation in particular, and blocks in the other direction of rotation, is provided in an advantageous manner between the holding surface, resting against the tool, of the clamping part that can be screwed onto the threaded pin and the section that has the inside thread. The clamping part can thus be unscrewed without problems. This clutch is advantageously embodied as a sliding clutch. In this way it is ensured that the clamping part to be screwed onto the threaded pin and that rests against the tool only rests by a predetermined tightening moment against the tool. With further screwing on, the sliding clutch free-wheels and prevents a stronger tightening of the clamping part.

In a particularly advantageous further development, it is provided that the one clamping part rests axially against the other clamping and friction part when the quick-action clamping device is tightened, because of which the holding surface of the clamping part that can be screwed onto the threaded pin comes into contact with the tool with a specific tightening moment. When the quick-action clamping device is screwed onto the spindle to secure the tool, first the clamping and friction part connected to the spindle in a manner fixed against relative rotation comes into contact with the tool, and is pressed against the tool via the other clamping part. Because of the axial contact of the one clamping part with the other, it is ensured that the holding surface of the clamping part provided with the thread only comes into contact with the tool by a specific tightening moment, thereby assuring a simple, later release of the quick-action clamping device.

The holding surface of the clamping and friction part that is fixed against relative rotation, with respect to the spindle, preferably axially projects slightly beyond the holding surface of the other clamping part in the direction of the tool. This ensures that, on the one hand, when the quick-action clamping device is tightened, the clamping and friction part that is fixed against relative rotation with respect to the spindle first comes into contact ahead of the other clamping part, or that the other clamping part first lifts from the tool when the quick-action clamping device is released and, on the other hand, that the clamping and friction part that is fixed against relative rotation with respect to the spindle rests against the tool with a greater tightening moment than the other clamping part. This also assures a simple release of even a very securely tightened quick-action clamping device, and no auxiliary tools are required.

The top surfaces of the holding surfaces of the clamping parts preferably have different frictional coefficients. Because of this, it can be ensured that the torque transfer from the tool to the clamping and friction part that is fixed against relative rotation with respect to the spindle is relatively great, so that the grinding wheel is braked relatively quickly when the spindle is blocked, whereas the extent to which the other clamping part is carried along by the still-rotating tool can be limited by a relatively low frictional coefficient.

The clamping and friction part that is fixed against relative rotation with respect to the spindle is preferably connected in the circumferential direction to the spindle and/or the flange with positive lockup. In this case it is provided that the clamping and friction part that is fixed against relative rotation with respect to the spindle is secured against relative rotation via a groove and tongue connection or the like to the spindle and/or to the flange via pins or the like that extend parallel to the spindle and engage the flange. This positive lockup permits an axial movement of the clamping and friction part, but prevents a relative rotational movement between the spindle or the flange and the clamping and friction part. This clamping and friction part accordingly executes exactly the same rotational movements as the spindle. In this way the other clamping part, which is screwed onto the threaded pin, can effectively brake via the brake when the spindle is blocked.

Further advantages, features and details of the present invention ensue from the following description, in which exemplary embodiments are represented in detail with reference to the drawings.

DETAILED DESCRIPTION OF THE PREFERRED EMBODIMENTS

Figure 1:
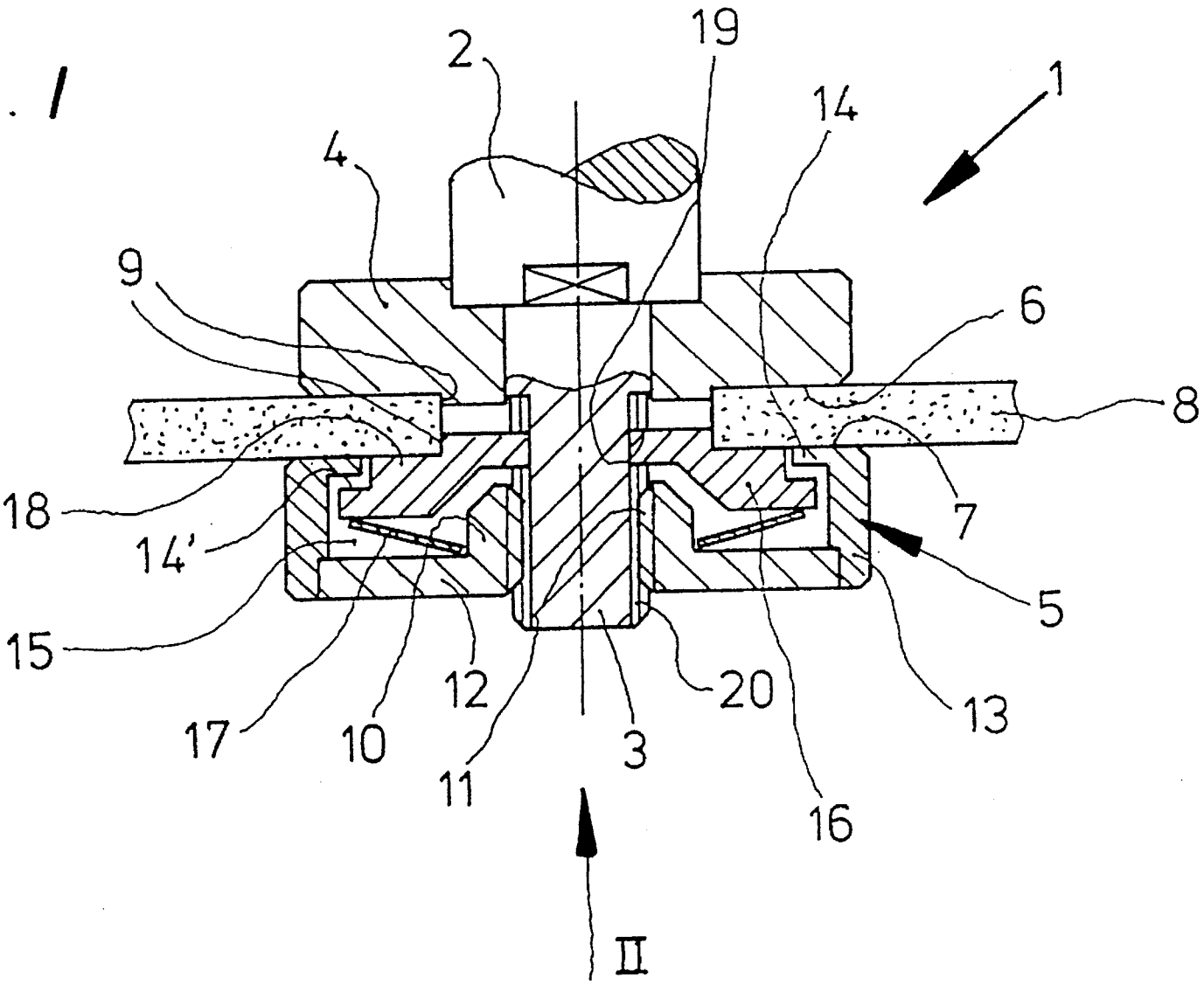
FIG. 1 is a longitudinal section through a first embodiment of a quick-action clamping device according to the present invention.
Figure 2:
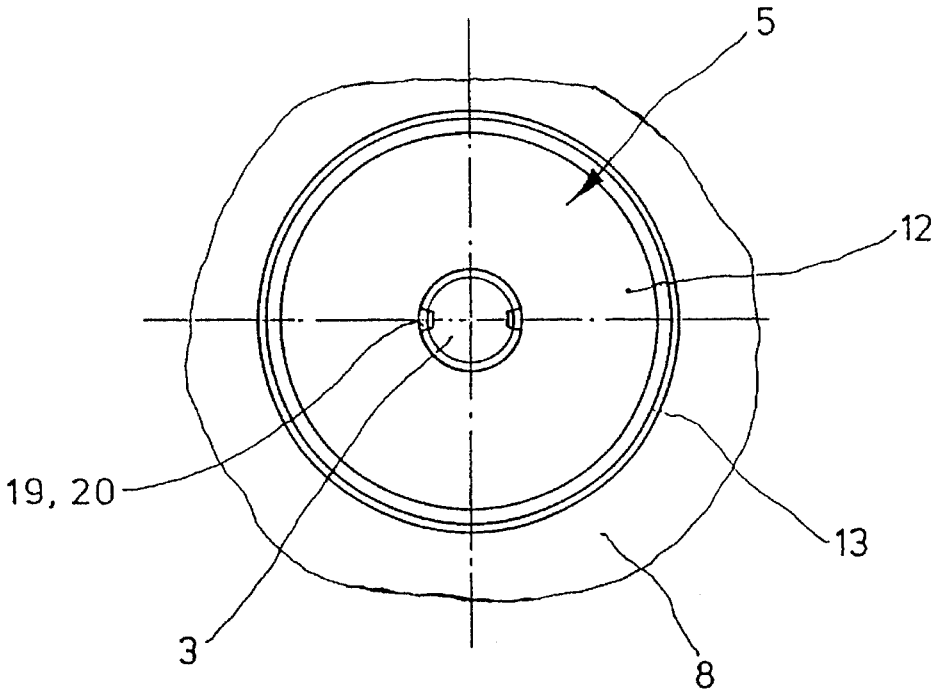
FIG. 2 is a longitudinal section through a second embodiment of a quick-action clamping device according to the present invention.
Figure 3:
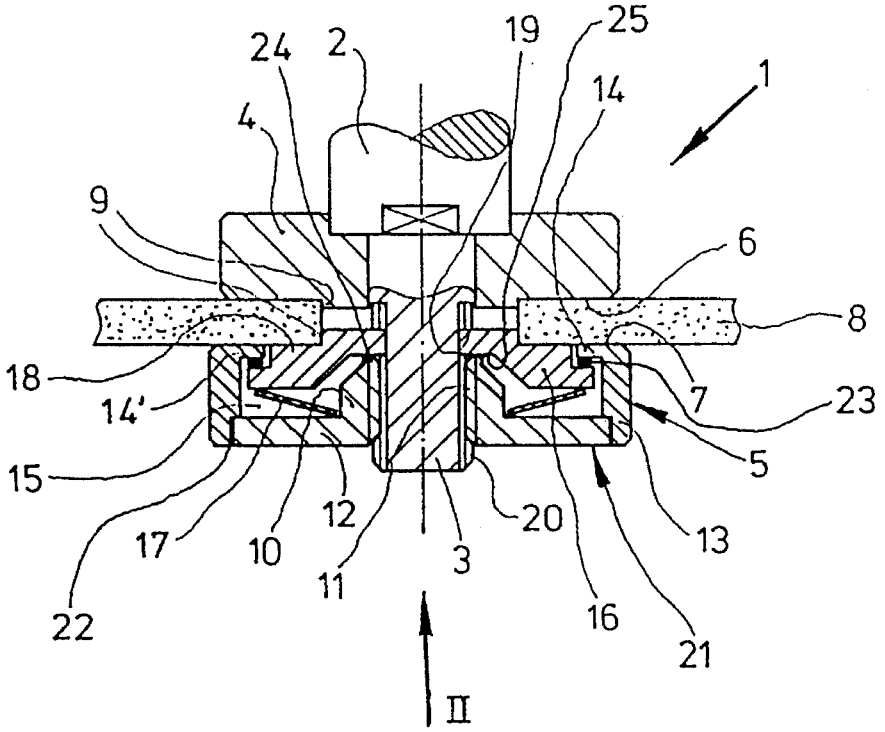
FIG. 3 is an axial viewed in the direction of arrow II in FIGS. 1 and 2.

The first and second exemplary embodiments shown in FIGS. 1 and 2 of a quick-action clamping device 1 have a spindle 2 with a threaded pin 3. A flange 4 is placed on the threaded pin 3, in a manner secured against relative rotation if need be. A first clamping part 5 is screwed onto the threaded pin 3, wherein a disk-shaped tool 8, such as a grinding wheel or cutting wheel, a saw blade or the like, is centered and securely clamped between a contact surface 6 of the flange 4 and a contact surface 7 of the clamping part 5.

The clamping part 5 itself comprises a plurality of parts combined to form one structural unit. A cylindrical part 10 has an inside thread 11, in which the threaded pin 3 of the spindle 2 is received. The cylindrical part 10 changes over in one piece into a disk-shaped part 12, onto which an axial ring 13 that has an inwardly-projecting shoulder 14 is placed in turn, optionally with the interposition of a one-way clutch. Together with the front side of the axial ring 13, this shoulder 14 forms the contact surface 7 that cooperates with the disk-shaped tool 8.

Together with the disk-shaped part 12, the axial ring 13 forms a recess 15, into which the cylindrical part 10 protrudes and in which an additional clamping and friction part 16 and a disk spring 17 are disposed in such a manner that they can be hidden from view. The disk spring 17 is held centered on the cylindrical part 10, and presses the clamping and friction part 16 in the clamped state against the disk-shaped tool 8 via a holding surface 18.

The clamping and friction part 16 has a stepped, circumferential surface or shoulder 14' that rests against the shoulder 14 as a consequence of the prestress of the disk spring 17 when the clamping part 5 is released.

The clamping and friction part 16 further has two catches 19 or other rotatable driving means symmetrically distributed at its circumference and that engage longitudinal grooves 20 of the threaded pin 3, so that the clamping and friction part 16 is held on the threaded pin 3 in a manner fixed against rotation relative thereto, but axially displaceable.

The mode of operation of the quick-action clamping device is as follows: after the machine, not shown in detail, that supports the quick-action clamping device 1 has been shut off, a spindle stop known per se and likewise not shown is operated while the machine is running down, and thus blocks the spindle 2 abruptly. The disk-shaped tool 8 continues to rotate because of its mass inertia, and in the process slides on the contact surface 6 of the flange 4. By means of friction, the contact surface 7 of the clamping part 5 is carried along, and the tension nut is therefore loosened.

Also during the release of the contact surface 7, the optional disk spring 17 presses the clamping and friction part 16 with its holding surface 18 further against the disk-shaped tool 8; in this manner a small gap that ensures that the clamping part 5 can no longer be rotated by means of friction is formed between the contact surface 7 of the clamping part 5 and the disk-shaped tool 8 during continued rotation of the tension nut. The clamping and friction part 16 is hampered in co-rotating by the securing device against relative rotation formed by the catches 19 and the longitudinal grooves 20, and aids in further braking the disk-shaped tool 8, wherein it is constantly pressed against the flange 4. However, the prestress of the disk spring 17 now permits the tension nut to be unscrewed easily by hand after the prestress has been released by means of the momentum of the disk-shaped tool 8.

To install a new disk-shaped tool 8, such as a grinding wheel, the spindle stop is again depressed. After placement of the tool 8, the tension nut is screwed on by hand until it rests against the disk-shaped tool 8. The force of the disk spring 17 is dimensioned such that the contact surface 7 can easily be brought into contact manually with the disk-shaped tool 8. This is completely sufficient. The disk-shaped tool 8 is automatically tightened further with the first activation of the machine and with subsequent operations.

Figure 4:
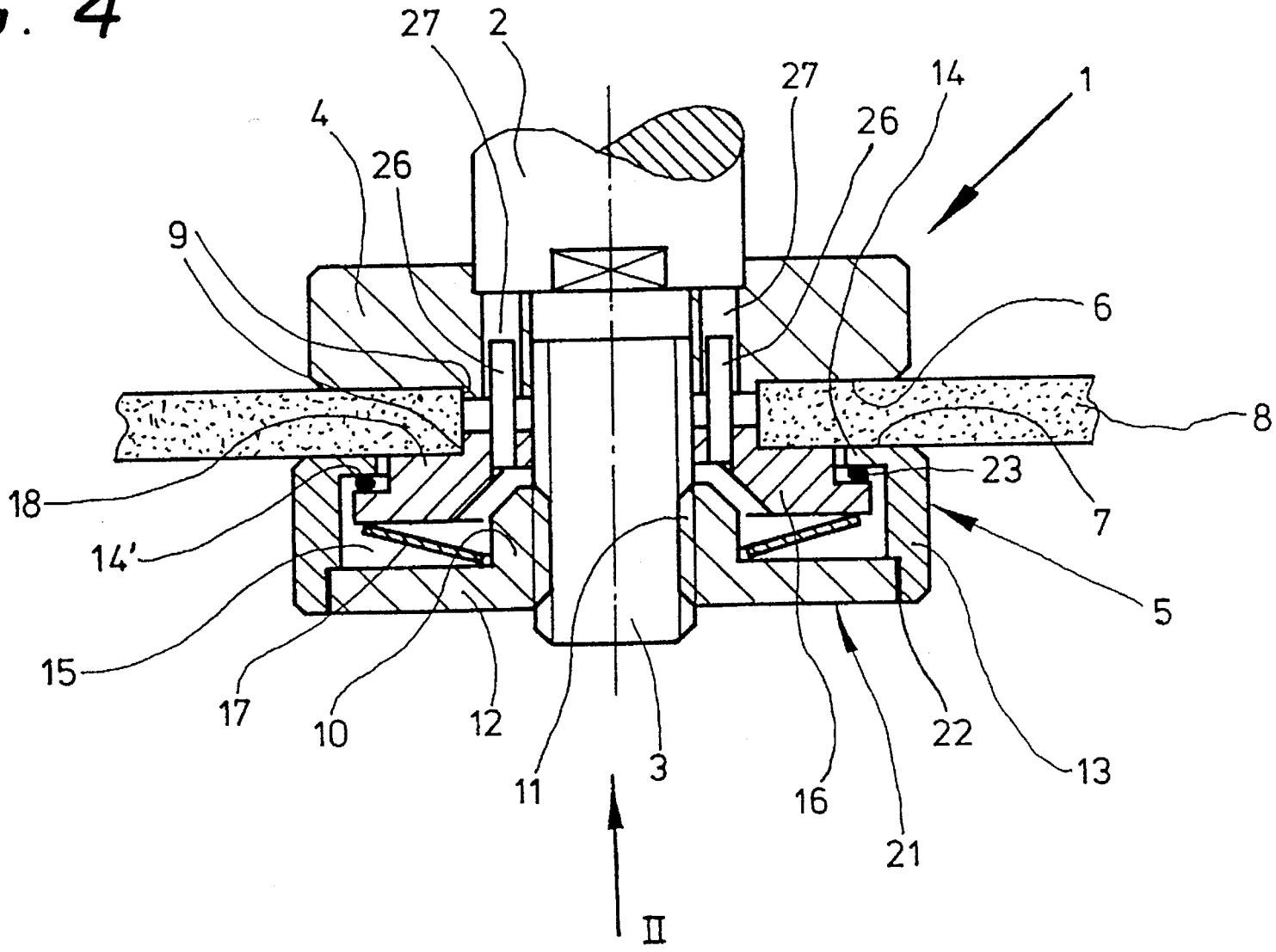
FIG. 4 is a longitudinal section through a third embodiment of a quick-action clamping device according to the present invention.

In the exemplary embodiments of FIGS. 2 and 4, the cylindrical part 10 is provided with a disk-shaped part 12, and forms a first segment 21. An axial ring 13 is placed on the disk-shaped part 12 with the interposition of a sliding clutch 22. The sliding clutch 22 is embodied such that it is only effective in one direction, namely in the tightening direction of the quick-action clamping device, i.e., it freewheels at a specific tightening moment, and transmits every torque in the loosening direction.

A frictional element 23 that acts as a brake and is embodied as an O-ring, for example, is disposed between the circumferential surface 14' and the shoulder 14. This frictional element 23 exerts a specific frictional force between the two clamping part 5 and the clamping and friction part 16. In this way relative motions between the two parts 5 and 16 are reduced.

Finally, it can be seen from FIG. 2 that the cylindrical part 10 of the clamping part 5 has at its axially inside end a circumferential collar 24 that rests against an inside surface 25 of the clamping and friction part 16 when the quick-action clamping device is tightened securely. By means of a suitable selection of the height of the collar 24, the tightening moment of the clamping part 5 against the tool 8, that is, the pressure of the holding surface 7 against the top surface of the tool 8, can be set to a specific value. When the clamping part 5 is tightened further, that is, screwed further onto the threaded pin 3, then the clamping and friction part 16 is pressed harder onto the tool 8 via the collar 24. However, the axial ring 13 rests with its shoulder 14 against the tool 8 with a defined tightening torque.

FIG. 4 shows a third exemplary embodiment in which the positive lockup between the clamping and friction part 16 and the spindle 2 is not effected via a catch 19 engaging a longitudinal groove 20 of the spindle 2, as in the exemplary embodiment of FIG. 1, but via pins 26 securely anchored in the clamping and friction part 16 and engaging recesses 27 provided in the clamping part 5. Twisting of the clamping and friction part 16 is hampered with respect to the spindle 2 via the recesses 27 and the pins 26. The clamping and friction part 16, however, can be removed axially without problems.

Because the clamping and friction part 16, which is connected with positive lockup to the spindle 3, is likewise at rest when the spindle 3 is at rest, the clamping part 5, which continues to rotate because of its mass inertia and the contact with the tool 8, is braked via the frictional element 23 in such a way that it likewise comes to a stop in a friction of a whole rotation. The clamping part 5 is not automatically loosened from the spindle 2, even when the spindle 2 is blocked and the tool 8 continues to rotate, and therefore does not represent a source of danger.

If a slide clutch 22 is provided between the segment 21 and the axial ring of the clamping part 5, then the tightening moment of the clamping part 5 is already predetermined when the quick-action clamping device 1 is tightened.

What is claimed is:

1. A quick-action clamping device for axially securing a disk-shaped tool on a flange of a driven, threaded spindle, the flange defining a contact surface, comprising:

a clamping part defining a contact surface and having a thread which engages the thread of the spindle, the tool being clamped between said contact surface of the flange and said contact surface of said clamping part, the spacing between the contact surface of the flange and said contact surface of said clamping part being changeable;

a clamping and friction part defining a holding surface in contact with said disk-shaped tool, said clamping and friction part being connected to said spindle such that relative rotation between said clamping and friction part and said spindle is prevented; and spring means for exerting a spring force such that the tool is pressed by said clamping and friction part against the contact surface of the flange.

2. The quick-action clamping device as defined in claim 1, wherein said additional clamping and friction part is disposed to be axially displaceable on the spindle, and wherein said holding surface of said additional clamping and friction part is located on that part of said additional clamping and friction part facing the tool.

3. The quick-action clamping device as defined in claim 2, wherein said spring means includes at least one compression spring disposed between said clamping part and said additional clamping and friction part.

4. The quick-action clamping device as defined in claim 2, wherein said clamping part includes a shoulder, and said additional clamping and friction part includes a shoulder, and wherein the axial displacement of said additional clamping and friction part is limited by both shoulders such that when said clamping part is released, the opposed surfaces of said shoulders are pressed against each other with prestress.

5. The quick-action clamping device as defined in claim 3, wherein said at least one compression spring comprises a disk spring.

6. The quick-action clamping device as defined in claim 3, wherein said clamping and friction part is provided with a recess within which said additional clamping and friction part and said compression spring are mounted, said additional clamping and friction part being mounted for axial play in said recess.

7. The quick-action clamping device as defined in claim 3, wherein said clamping part includes a cylindrical part defining an inside thread, an adjacent disk-shaped part, and an axial ring at its outer circumference that defines a shoulder that projects inwardly at a distance from the disk-shaped part, said shoulder and said axial ring defining the contact surface of said clamping part, and wherein said at least one compression spring is centered by said cylindrical part.

8. The quick-action clamping device as defined in claim 1, wherein said additional clamping and friction part is held on said clamping part.

9. The quick-action clamping device as defined in claim 1, wherein the spindle is provided with at least one longitudinal groove and said additional clamping and friction part is provided with at least one latch engaging said longitudinal groove for securing said additional clamping and friction part against relative rotation with respect to the spindle.

10. The quick-action clamping device as defined in claim 1, wherein the flange of the spindle and said additional clamping and friction part are secured against relative rotation on the spindle by a common securing device.

11. The quick-action clamping device as defined in claim 1, wherein said additional clamping and friction part includes a centering shoulder for the tool.

12. The quick-action clamping device as defined in claim 1, further comprising:

a device that at least partially reduces relative motion between the clamping part and said clamping and friction part, said device being provided between the clamping part and said clamping and friction part, said device being screwed onto the spindle.

13. The quick-action clamping device as defined in claim 1, further comprising:

a device that at least partially reduces relative motion between the clamping part and said clamping and friction part, said device being provided between the spindle and said clamping part, said device being screwed onto the spindle.

14. The quick-action clamping device as defined in claim 1, wherein the device is embodied as a brake.

15. The quick-action clamping device as defined in claim 14, wherein said brake comprises a frictional element.

16. The quick-action clamping device as defined in claim 15, wherein said friction element comprises an O-ring.

17. The quick-action clamping device as defined in claim 1, further comprising:

a clutch situated between said clamping part and said disk-shaped part for transmitting torque effectively in one direction of rotation.

18. The quick-action clamping device as defined in claim 1, wherein when the device is securely tightened, the two contact surfaces are in axial engagement with the tool.

19. The quick-action clamping device as defined in claim 18, wherein said holding surface is located such that it extends beyond said contact surface of said clamping part toward the tool when the clamping part and said clamping and friction part are in engagement.

20. The quick-action clamping device as defined in claim 1, wherein said contact surface of said clamping part and said holding surface have different friction values.

21. The quick-action clamping device as defined in claim 1, further comprising:

lockup means connected to the spindle, wherein said clamping and friction part is fixed against relative rotation with respect to the spindle by said lockup means.

22. The quick-action clamping device as defined in claim 1, further comprising:

lockup means connected to said flange, wherein said clamping and friction part is fixed against relative rotation with respect to said flange by said lockup means.

23. The quick-action clamping device as defined in claim 1, further comprising:

lockup means connected to the spindle and said flange, wherein said clamping and friction part is fixed against relative rotation with respect to the spindle and said flange by said lockup means.

24. The quick-action clamping device as defined in claim 1, further comprising:

a device for partially reducing the relative motion between said clamping part and said clamping and friction part, wherein said clamping part and said clamping and friction part define a radial gap and said device for partially reducing the relative motion between said clamping part and said clamping and friction part is disposed in said radial gap.

25. The quick-action clamping device as defined in claim 1, further comprising:

a device for partially reducing the relative motion between said clamping part and said clamping and friction part, wherein said clamping part and said clamping and friction part define an axial gap and said device for partially reducing the relative motion between said clamping part and said clamping and friction part is disposed in said radial gap.

26. The quick-action clamping device as defined in claim 1, further comprising:

a device for partially reducing the relative motion between said clamping part and said clamping and friction part, wherein said clamping part and said clamping and friction part define a radial and axial gap and said device for partially reducing the relative motion between said clamping part and said clamping and friction part is disposed in said radial and said axial gap.

* * * * *